US006205808B1

(12) United States Patent
Beekman

(10) Patent No.: US 6,205,808 B1
(45) Date of Patent: Mar. 27, 2001

(54) PREVENTION OF OIL BACKFLOW FROM A SCREW COMPRESSOR IN A REFRIGERATION CHILLER

(75) Inventor: Dennis M. Beekman, La Crosse, WI (US)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/390,103

(22) Filed: Sep. 3, 1999

(51) Int. Cl.[7] ..... F25B 43/02
(52) U.S. Cl. ..... 62/469; 62/470; 418/DIG. 1
(58) Field of Search ..... 62/84, 468, 469, 62/470; 417/372; 418/97, 98, 100, DIG. 1

(56) References Cited

U.S. PATENT DOCUMENTS 4,662,190 * 5/1987 Tischer ..... 62/470
5,029,455 * 7/1991 Backus et al. ..... 62/470
5,055,010 * 10/1991 Logan ..... 418/DIG. 1
5,086,621 2/1992 Starner et al. ..... 62/84
5,219,281 * 6/1993 Caillat et al. ..... 418/DIG. 1
5,222,874 * 6/1993 Unnewehr et al. ..... 417/372
5,396,784 3/1995 Huenniger ..... 62/471
5,421,708 * 6/1995 Utter et al. ..... 418/DIG. 1
5,683,236 * 11/1997 Harrison et al. ..... 418/DIG. 1
5,761,914 * 6/1998 Carey et al. ..... 62/84

* cited by examiner

*Primary Examiner*—Corrine McDermott
*Assistant Examiner*—Chen-Wen Jiang
(74) *Attorney, Agent, or Firm*—William J. Beres; William O'Driscoll; Peter D. Ferguson

(57) ABSTRACT

A screw compressor in a refrigeration chiller includes one or more baffles disposed in the compressor housing so as to intercept and redirect oil which may flow and/or be blown, under certain operating conditions, in an upstream direction against the stream of suction gas that flows into the compressor from the evaporator. The baffles cause oil to be retained in the compressor rather than being blown back to the system evaporator to ensure that sufficient oil is available to the compressor under all operating conditions and eliminates the need for structure/apparatus in the evaporator dedicated to returning such oil to the compressor.

30 Claims, 3 Drawing Sheets

PREVENTION OF OIL BACKFLOW FROM A SCREW COMPRESSOR IN A REFRIGERATION CHILLER

BACKGROUND OF THE INVENTION

The present invention relates to screw compressors. More particularly, the present invention relates to screw compressors employed in refrigeration chillers. With still more particularity, the present invention relates to the prevention of oil backflow out of a screw compressor in a refrigeration chiller and the loss of oil to the system evaporator as a result thereof.

Screw compressors are compressors in which two or more screw rotors are disposed in an intermeshing relationship in a working chamber. The counter-rotation of the screw rotors draws gas into the working chamber at a first, relatively low pressure, causes the compression of such gas within the working chamber and causes the discharge of such gas at a higher, so-called discharge pressure therefrom.

In many screw compressor applications, including application in refrigeration chillers, oil may be injected directly into the compressor's working chamber for cooling and sealing purposes. Additionally, oil is used to lubricate the compressor bearings. Oil used for bearing lubrication in refrigeration chillers is typically vented/directed to a location within the compressor where refrigerant gas at a relatively low pressure is found. Such oil will, therefore, eventually make its way into the compressor's working chamber and become entrained in the refrigerant gas that flows through it. Such oil, together with any oil that was injected directly into the compressor's working chamber, is then carried out of the compressor entrained in the flow stream of gas discharged from the compressor.

Because the flow stream of refrigerant gas issuing from a screw compressor in a refrigerant chiller contains a relatively large amount of oil and because such oil needs to be returned to the compressor for the various purposes mentioned above, an oil separator is typically located in or immediately downstream of the compressor for the purpose of disentraining the oil from the discharge gas flow stream and gathering it for return to the compressor. In many chiller systems, it is the discharge pressure found in the oil separator that is used to drive the separated oil from the oil separator back to the compressor.

While the oil separates used in such systems are very highly efficient, typically disentraining 99% or more of the oil from the refrigerant gas flowing therethrough prior to the exit of the gas for delivering to the system condenser, it will be appreciated that over time the compressor's oil supply can come to be depleted. Any oil that makes its way past the system oil separator is typically carried into and through the system condenser and winds up in the system evaporator pooled on or in the liquid refrigerant that will be found at the bottom thereof. Provisions are typically made for regularly returning this relatively small amount of oil from the system evaporator back to the system compressor, such oil migration, once again, being typical in refrigeration chillers of all types and typically involving only a relatively very small amount of oil as a percentage of the chiller's oil supply.

Because there is a direct flow path from the chiller's evaporator to the chiller's compressor component through which suction gas is drawn into the compressor, the possibility does exist, under some conditions, for oil located within the compressor to flow out of the compressor, in a direction back toward and even into the evaporator. Such conditions are somewhat unique to and are exacerbated in refrigeration chillers that employ screw compressors due to the amount of oil which is used for various purposes within such compressors and due to the fact that the system evaporator is located below and generally in an open flow relationship with the suction area of the compressor in such systems. Oil flow directly into the system evaporator from the compressor, while atypical, can sometimes be in quantities greater than it is the capacity of the oil return apparatus associated with the evaporator to cope with and can result in chiller shutdown for lack of oil in sufficient quantity in the proper location to ensure that the compressor is continuously and adequately supplied with oil while in operation.

Exemplary of previous arrangements by which such oil is caught and trapped for return to the compressor in a refrigeration chiller after backflowing thereoutof are those found in U.S. Pat. Nos. 5,086,621 and 5,396,784. The '621 patent addresses the oil backflow problem by positioning a tray within the evaporator beneath the piping through which suction gas is drawn from the evaporator to the compressor. That tray catches and accumulates any backflowing oil. Such oil is then returned on a continuing basis to the system compressor by use of the eductor apparatus.

The '784 patent likewise teaches the positioning of a tray beneath the evaporator outlet in a refrigeration chiller to catch and return backflowing oil. In the '784 patent, however, when the level of oil in the tray becomes sufficiently high, gas flow from the evaporator to the compressor comes to be restricted with the result that gas flow velocity is caused to increase. The increased flow velocity of the gas flowing out of the evaporator to the compressor causes the entrainment of oil located in the tray in the gas stream flowing out of the evaporator back to the compressor.

As will be appreciated, both such arrangements require the fabrication and installation of parts/components which are assembled into the system evaporator to address the oil backflow problem. Such parts/components, their fabrication and installation come at significant expense and their operation comes at some expense in terms of the overall power consumed by the chiller system.

The need continues to exist for an arrangement by which to prevent the backflow of oil from a screw compressor to the evaporator in a refrigeration chiller system which does not add significantly to the expense of the compressor or chiller system and which does not penalize chiller efficiency.

SUMMARY OF THE INVENTION

It is an object of the present invention to limit and/or prevent the backflow of oil from a compressor in a refrigeration chiller to the chiller system evaporator.

It is another object of the present invention to prevent the backflow of oil from the compressor to the evaporator in a refrigeration chiller system by intercepting and re-directing backflowing oil within the compressor, prior to its escape therefrom.

It is a still further object of the present invention to prevent the backflow of essentially all oil from the compressor to the evaporator in a refrigeration chiller system in a manner which is passive and which adds relatively very little expense to the cost of the chiller system in terms of its fabrication, in terms of the parts/components employed for the oil backflow prevention purpose and in terms of its effect on chiller operating efficiency.

These and other objects of the present invention, which will be appreciated when the following Description of the Preferred Embodiment and the attached Drawing Figures are considered, are accomplished in a refrigeration chiller system that employs a screw compressor in which one or more oil backflow baffles are strategically placed upstream of the compressor's working chamber and/or suction area to intercept backflowing oil and to re-direct it back to the compressor without permitting its escape from the compressor housing in the first instance. In the preferred embodiment, such baffles are disposed in the portion of the compressor housing in which the compressor's drive motor is disposed. The drive motor, in the preferred embodiment, is cooled by the flow of refrigerant gas from the system evaporator enroute to the working chamber of the compressor. Under those relatively infrequent chiller operating conditions during which oil backflow from the compressor to the evaporator might otherwise occur, the baffles act to block the backflow of oil from the compressor housing and to re-direct it in an upstream direction for use in the compressor.

DESCRIPTION OF THE DRAWING FIGURES

FIG. 1 schematically illustrates the refrigeration chiller of the present invention.

DESCRIPTION OF THE PREFERRED EMBODIMENT

Figure 1:
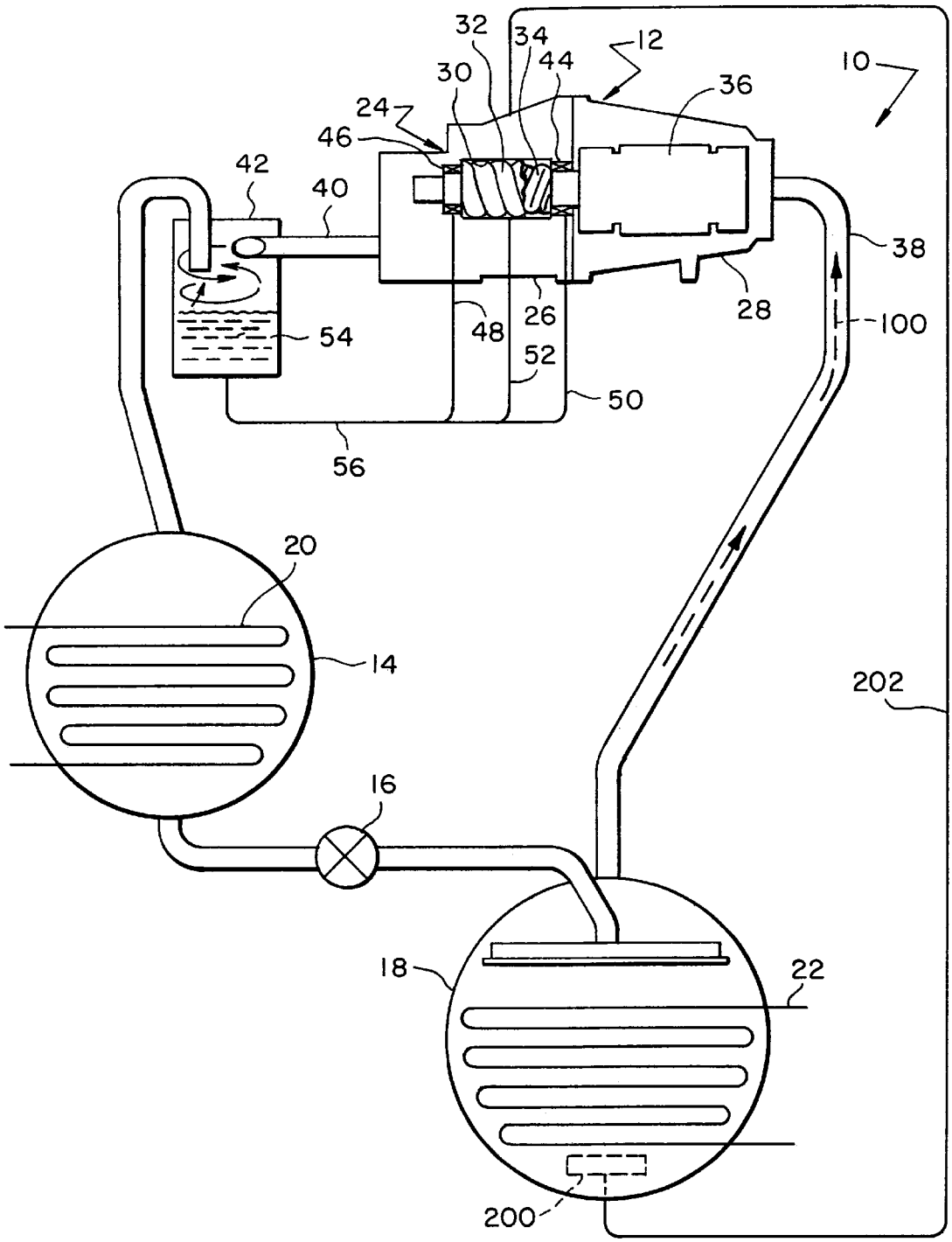

Referring first to Drawing FIG. 1, refrigeration chiller 10, in its most basic form, includes a compressor portion 12, a condenser 14, an expansion device 16 and an evaporator 18 all of which are connected for flow to form a refrigeration circuit. Generally speaking, refrigerant gas is compressed in compressor 12 and is discharged therefrom at relatively high pressure and temperature. Such gas is delivered to condenser 14 where it is cooled and condensed in a heat exchange relationship with a relatively cooler medium, such as water, flowing through tube bundle 20.

The now condensed refrigerant flows from condenser 14 to expansion device 16 where, by its passage therethrough, the pressure and temperature of the refrigerant is reduced. A portion of the liquid refrigerant flowing through device 16 vaporizes in the expansion process. The now two-phase refrigerant flows from expansion device 16 into evaporator 18 where it is brought into heat exchange contact with a medium flowing through tube bundle 22.

The medium flowing through tube bundle 22 within evaporator 18 carries with it heat from the heat load which it is the purpose of chiller 10 to cool. Such heat will be rejected from that medium to the relatively cooler, low pressure refrigerant that is delivered into evaporator 18 which, in turn, causes the vaporization of the majority of the liquid portion thereof. The now cooled medium flowing within tube bundle 22 is delivered back to the heat load in order to further cool it. At the same time, the vaporized refrigerant in evaporator 18 is drawn thereoutof back to compressor 12 where it is recompressed for delivery to the condenser in an ongoing process.

In the preferred embodiment of the chiller system of the present invention, compressor 12 is a compressor of the screw type. In that regard, compressor 12 has a housing 24 which generally includes a rotor housing 26 and a motor housing 28. Rotor housing 26 defines a working chamber 30 in which a first screw rotor 32 and a second screw rotor 34 are disposed in a counter-rotating, intermeshed relationship. Compressor drive motor 36 is disposed in motor housing 28 and is connected to one of rotors 32 and 34 so as to drive it.

In the chiller of the preferred embodiment, suction gas is drawn out of evaporator 18 through suction line 38 which opens into the motor housing portion 28 of compressor housing 24. The suction gas flows through motor housing 28, around motor 36 and cools motor 36 in the process. The suction gas is then drawn into working chamber 30, where it is compressed by the counter rotation of the motor-driven screw rotors, and is discharged through discharge line 40 to an oil separator 42 prior to flowing downstream to condenser 14 as was earlier described.

As is the case with most compressors, including screw compressor 12 of the preferred embodiment, one or more components thereof will be a rotating part and, as such, will typically be mounted in bearings. As is also typical, such bearings require lubrication. In the chiller system of the preferred embodiment, screw rotors 32 and 34 are mounted for rotation in bearings, such as bearings 44 and 46, which require lubrication. Because compressor 12 is a screw compressor, there is also a need to use oil for additional purposes. These additional purposes can include the cooling of refrigerant gas undergoing compression and/or the cooling of the screw rotors within the working chamber as well as the sealing of the interfaces between the rotating screw rotors themselves and between the rotors and the walls of working chamber 30.

Figure 2:
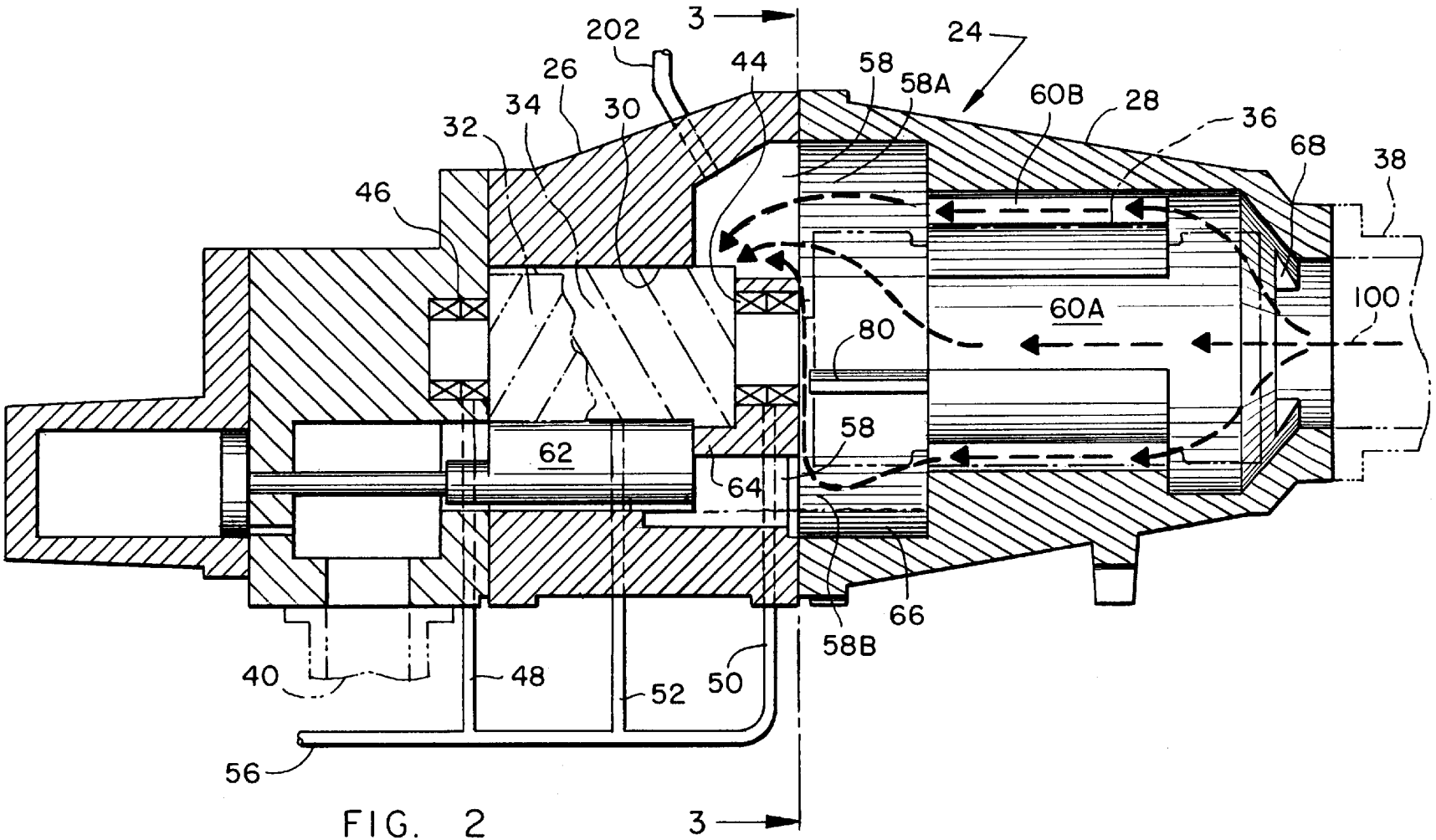
FIG. 2 is a cross-sectional view of the compressor portion of the refrigeration chiller of FIG. 1.

With the above in mind and referring additionally now to FIG. 2, chiller 10 requires the use of a significant amount of oil, such oil being delivered, for example, to bearings 44 and 46 through supply lines 48 and 50. Oil is also injected into working chamber 30 of compressor 12 through supply line 52 which opens into working chamber 30 at a location where the pressure of the refrigerant gas undergoing compression is less than discharge pressure.

Such oil is sourced from sump 54 of oil separator 42 and flows through line 56 to supply lines 48, 50 and 52 under the impetus of the disclosure pressure found in oil separator 42. That pressure will be greater than the pressure found at the locations of oil use and/or the locations to which such oil is directed/vented/drained after being used in the compressor for its intended purpose. While oil separator 42 is highly efficient, a relatively very small portion of the oil that issues from compressor 12 entrained within the discharged refrigerant gas will make its way, with the refrigerant gas, past the oil separator and will settle in evaporator 22. Such oil, which is, once again, relatively small in quantity, is returned for use in the compressor by apparatus 200, shown in phantom in FIG. 1, which directs such oil back to compressor 12 through line 202.

Among the locations to which oil will make its way after use within the compressor is suction area 58 of the compressor. Under normal operating conditions, the flow of gas to and through compressor 12 is sufficiently high to ensure that oil located within and in the vicinity of suction area 58 is drawn into, passes through and passes out of the compressor's working chamber to oil separator 42 entrained in that gas. When load conditions are such that the amount of gas flowing into the compressor from the evaporator is significantly reduced, the dynamics of drive motor and screw rotor rotation within the compressor housing, together with pressure pulsations that can come to exist under such conditions, can act to blow oil out of suction area 58 of the compressor, back through the motor housing and into the system evaporator, against the significantly reduced resistance offered by the relatively anemic stream of gas flowing to the compressor from the evaporator. Under certain of such conditions, oil blowback can be sufficiently forceful and sustained to cause a relatively large portion of the compressor's oil supply to be blow out of the compressor to the system evaporator. It is generally beyond the capacity of oil return apparatus 200 to return this amount of oil to the compressor in a timely fashion and if such circumstances are not otherwise addressed, compressor shutdown and/or damage for lack of oil can result.

Figure 3:
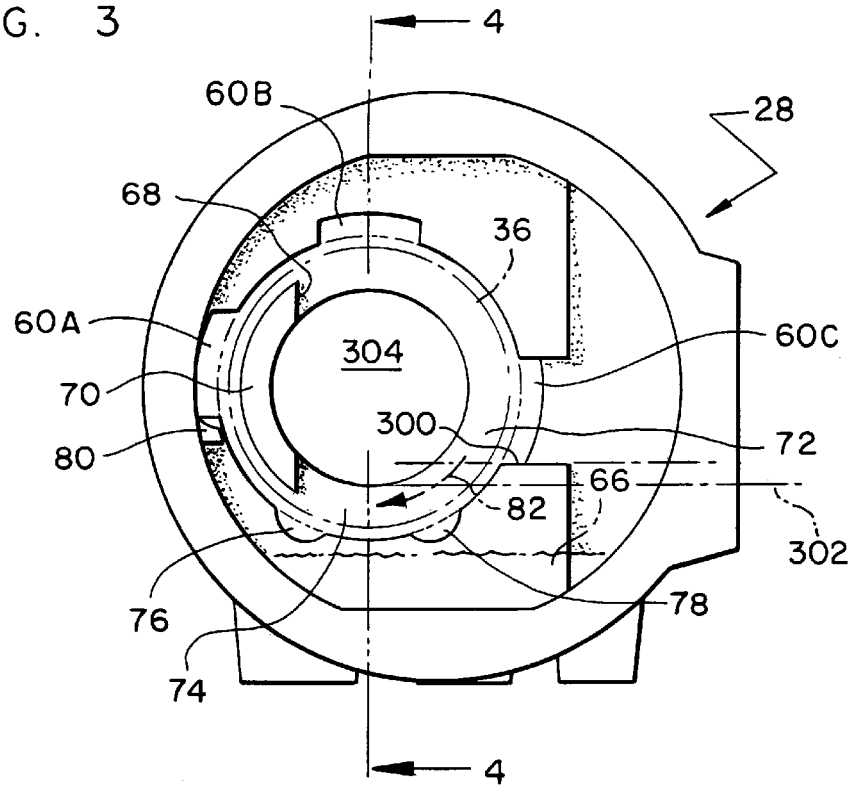
FIG. 3 is an end view of the motor housing of the compressor illustrated in FIG. 2 and taken along line 3—3 therein.
Figure 4:
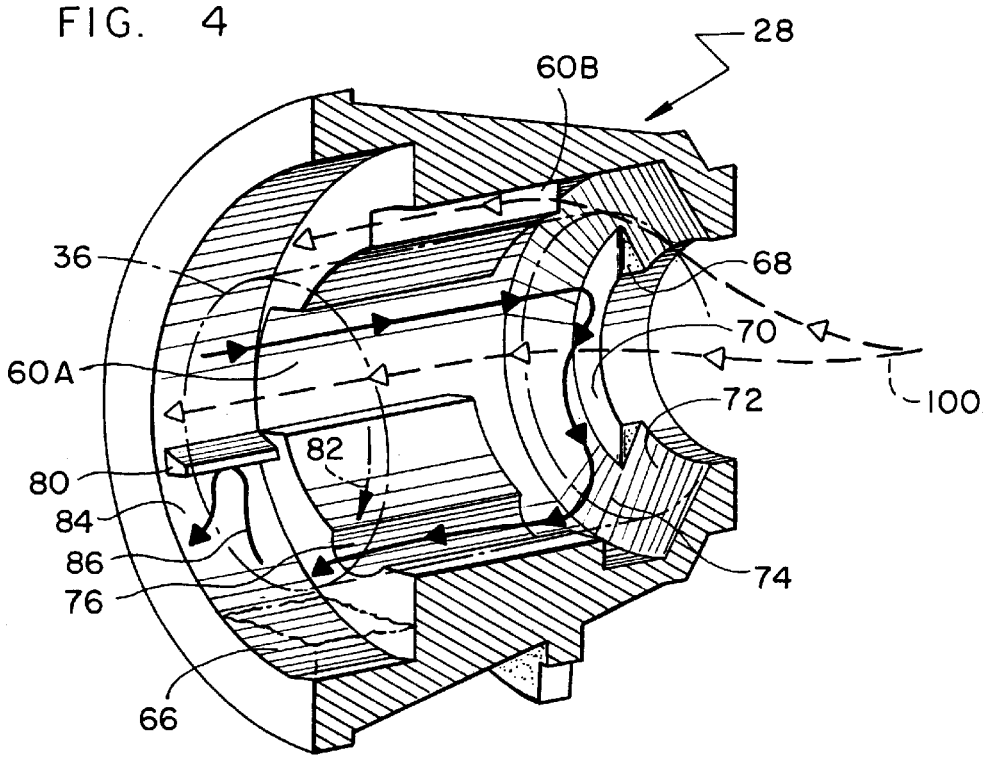
FIG. 4 is a perspective cross-sectional view of the motor housing of FIG. 3 taken along line 4—4 therein.

Referring additionally now to FIGS. 3 and 4, the flow of suction gas from evaporator 18 through line 38, in the preferred embodiment, is into motor housing 28, as is indicated by arrows 100. Once in the motor housing, the suction gas flows through, over and around motor 36, cooling it in the process. While some of the flow of suction gas is through the relatively small rotor-stator gap of the motor (not shown), it is much more so around and over motor 36 through suction gas passages 60A, 60B and 60C which are defined, in the preferred embodiment, by the interior walls of the motor housing. Once past the driver motor, the suction gas flows into suction area 58, which is generally located and defined at the interface of the rotor housing and motor housing portions of compressor housing 24. From there, the gas is drawn into the compressor's working chamber.

When compressor 12 is fully loaded, slide valve 62 abuts slide stop 64, as is illustrated in Drawing FIG. 2, with the result that all of the suction gas that enters suction area 58 comes to be directed and drawn into suction subarea 58A. Suction subarea 58A is the location of the compressor's suction port, the suction port being the location where gas exists the suction area of the compressor and is drawn into the working chamber. Suction gas flows into the compressor's working chamber through the suction port, is compressed therein and is delivered out of the compressor to oil separator 42 through discharge line 40. Suction gas flow under full load conditions is most typically in relatively large quantity and at relatively high velocity and will, as will further be described, tend to pick up and carry oil that has made its way into subarea 58B of suction area 58, such as the oil in pool 66.

When chiller 10 operates less than fully loaded, slide valve 62 is retracted from slide stop 64 by a distance appropriate to the load on the chiller, thereby exposing a portion of the working chamber 30 and the screw rotors therein back to suction area 58 in a manner which effectively short circuits a portion of the refrigerant gas flow through the working chamber. The effect of slide valve retraction is to reduce the effective length of the screw rotors, thereby reducing the capacity of the compressor. In the case of compressor 12 the intermeshed, counter-rotating screw rotors are exposed, when slide valve 62 is retracted, to subarea 58B of the compressor's suction area 58. Suction subarea 58B is generally located at the bottom of the compressor, opposite suction subarea 58A, and is, as indicated, a location where oil tends to collect after being used in the compressor for various purposes.

The retraction of slide valve 62 away from slide stop 64 is a typical and normal occurrence but its effect is to set up some disruption in the suction gas flow pattern within the suction area compressor. Further, the retraction of slide valve 62 away from slide stop 64 exposes the screw rotors, which are rotating at high speed, to the pool of oil 66 that collects in suction subarea 58B. The amount of such oil can be fairly significant and will vary depending on system operating conditions. Under most conditions, oil is continuously drawn off of and out of pool 66 by suction gas flow and is carried therewith into and through the working chamber and into the system oil separator, even when the slide valve is retracted.

As has been mentioned, however, under some chiller operating conditions, particularly when slide valve 62 is fully or near fully retracted, oil in suction area 58, including the oil in pool 66, can be blown out of compressor 12, against suction gas flow, back to the system evaporator. Whereas previous arrangements have relied upon the trapping and/or collection of such oil in the system evaporator and on apparatus configured to accomplish the return of such oil from the system evaporator to the compressor, the chiller of preferred embodiment of the present invention seeks to prevent the backflow of oil out of the compressor housing in the first instance.

In that regard, one or more baffles are strategically disposed upstream of working chamber 30 in compressor housing 24 at a location or locations which prevent and/or result in the physical interception and/or re-direction of the majority of any oil backflowing therein. Such baffles do not, however, adversely affect or disrupt the normal flow of gas to the compressor's working chamber to any significant degree. First baffle 68, in the preferred embodiment, is positioned generally at the end of motor housing 28 which is closest to suction line 38 and includes a generally planar wall 70 which faces in the downstream gas flow direction into suction gas passage 60A. Wall 70, while not being impinged upon by or otherwise inhibiting suction gas flow in its normal downstream flow direction through compressor housing 24, presents directly into the face of any oil which is blown upstream through passes 60A back toward suction line 38.

It is to be noted that while some oil may escape baffle 68 and flow to the evaporator from the compressor in the upstream direction, the amount thereof is, under most circumstances, manageable. Further, that relatively small amount of oil is capable of being returned to the compressor, under typical operating conditions, by apparatus 200 the primary purpose of which is to return the relatively small amount of oil that makes its way to the evaporator in a downstream flow direction during the normal course of chiller operation.

Oil impinging upon wall 70 of baffle 68 will drain theredown, by force of gravity, to sloped wall 72 and then to the bottom of the motor housing such as to location 74. Like wall 30, wall 72 is generally unexposed to, is generally unaffected by and does not generally effect the normal downstream flow of gas into and through the motor housing to suction area 58. Oil making its way into location 74 flows into oil return passages 76 and 78, which are defined the bottom of the motor housing. Passages 76 and 78, in turn, deliver such oil back to pool 66 in suction subarea 58B of the compressor housing from where it will be drawn into the compressor's working chamber when chiller operating conditions normalize.

A second baffle 80 is disposed in compressor housing 24 of the preferred embodiment between lubricator pool 66 and the location at which suction gas flows out of suction gas passage 60A and into suction area 58 in the downstream flow direction. The physical makeup of the compressor of the preferred embodiment is such that the counter-rotation of the screw rotors in the compressor's working chamber, the relative location and disposition of the suction gas passage in the motor housing, the relative location and disposition of the compressor's drive motor and the drive motor's direction of rotation 82 all cooperate to result in a tendency for lubricant in pool 66 to be carried/blow upward along surface 84 of motor housing 28 toward the exit of passage 60A.

Under normal operating conditions and in the absence of baffle 80, lubricant travelling upward along surface 84 would become entrained in the suction gas exiting suction gas passage 60A and would be delivered into the working chamber of the component therewith. Under the light load/extreme ambient temperature conditions referred to earlier, however, when gas flow through passage 60A is in relatively small quantity and/or at relatively low velocity, oil travelling upward along surface 84 can, in the absence of baffle 80, be blown back through suction gas passage 60A, against the weak suction gas stream flowing downstream therethrough.

By positioning second baffle 80 immediately below the exit of passage 60A in the motor housing, the majority of any oil flowing upward along surface 84 out of pool 66 is, as is indicated by arrow 86 in FIG. 4, intercepted, deflected and redirected and is effectively blocked from entering the vicinity of the exit of passage 60A. As such, second baffle 80 effectively prevents, in the first instance, the delivery of a majority of the oil in pool 66 to a location in suction area 58, where it is likely to be blown back out of the compressor housing. Baffle 68, on the other hand, is positioned to intercept the oil which is, in fact, blown back through suction gas passage 60A and is configured to direct such lubricant downward, at the upstream end of the motor housing, into passages that return such oil to pool 66.

As will be noted and appreciated, the compressor in the chiller of the present invention makes use of two baffles and is a screw compressor in which suction gas flows around and cools the compressor drive motor prior to entering the compressor's working chamber. It is to be understood that the present invention has application not only to screw compressors where the compressor drive motor is upstream of the compressor and is cooled by suction gas, but to compressors in which suction gas is drawn directly through a suction area and into the compressor's working chamber without interacting with a drive motor, such as to cool it.

Further, in the compressor of the chiller of the present invention, oil found in suction area 58 will tend to be moved by the dynamics of gas flow and rotor rotation in a direction and into a location within a suction area 58 where, if low load/extreme ambient temperature conditions exist, it is likely to be blown back out of the compressor housing through suction gas passage 60A as opposed to the other suction gas passage defined in the motor housing. That is, in the compressor of the chiller of the present invention, oil will not tend to accumulate in a location where it is likely to be blown back of suction gas passage 60B or 60C, even when low load/extreme ambient conditions exist. As such, baffles 68 and 80 are located and configured with respect to suction passage 60A to take into account the configuration and oil backflow tendencies of the compressor of the preferred embodiment. In other compressors, more or one fewer baffle might be required to intercept and/or prevent oil backflow and the locations of such baffles might be different from those in the compressor of the chiller of the preferred embodiment. Such arrangements do, as will be appreciated, fall within the scope of the present invention.

Still further, it is to be noted that in some compressor configurations oil return passages 76 and 78 can be dispensed with. For instance and with reference to FIG. 3, if the height of surface 300 in motor housing 28, which cooperates in the definition of suction gas passage 60C, were lowered, such as to the height indicated by dashed line 302 which is at or below the lowermost point of aperture 304 through which suction gas enters motor housing 28, oil at the upstream end of the motor housing would return to suction area 58 through passage 60C without the need for passages 76 and 78. In that regard, it will be remembered that passage 60C is not one through which oil tends to be blown back out of the compressor. Therefore, while the use of oil return passages 76 and 78 is mandatory in some instances, their use in other instances and compressor configurations may not be.

While the present invention has been described in terms of a preferred embodiment, other modifications, additions, alterations and the like thereto will be apparent to those skilled in the art. As such, the scope of the present invention is not limited to the configuration of the preferred embodiment described herein.

What is claimed is:

1. A refrigeration chiller comprising:

a condenser;

an expansion device;

an evaporator;

a compressor, said compressor, said condenser, said expansion device and said evaporator being serially connected for refrigerant flow and forming a refrigeration circuit, and compressor having a housing, at least one baffle, a working chamber and a location, upstream of said working chamber, where oil tends to collect, said at least one baffle being disposed upstream of said working chamber in said housing and being positioned to prevent the flow of oil out of said housing against refrigerant gas flowing in a downstream flow direction through said housing from said evaporator to said working chamber.

2. A refrigeration chiller according to claim 1 wherein said at least one baffle is positioned to both intercept and redirect oil which backflows from said location where oil tends to collect in said compressor housing.

3. The refrigeration chiller according to claim 1 wherein oil redirected by said baffle is redirected into said location where oil tends to collect.

4. The refrigeration chiller according to claim 3 further comprising a compressor drive motor, said compressor drive motor being disposed in said compressor housing upstream of said working chamber and upstream said location where oil tends to collect and downstream of the location at which refrigerant gas flows into said compressor housing from said evaporator.

5. The refrigeration chiller according to claim 4 wherein said at least one baffle is disposed upstream of said compressor drive motor.

6. The refrigeration chiller according to claim 5 wherein said compressor housing defines one or more suction gas flow passages running along the length and exterior of said compressor drive motor, the majority of the suction gas flowing into said compressor housing flowing through said one or more suction gas passages enroute to said working chamber, said at least one baffle having a face disposed so as to face downstream into at least one of said suction gas passages so that oil flowing in an upstream direction therethrough will tend to impact said face and to drain theredown.

7. The refrigeration chiller according to claim 6 wherein said compressor housing defines one or more oil-return passages, said one or more oil return passages communicating between a location upstream of said motor, into which oil draining down said face of said at least one baffle is deposited, and a location downstream of said motor where oil flowing out of said at least one oil return passage flows into said location where oil tends to collect.

8. The refrigeration chiller according to claim 7 wherein said compressor has two baffles, a first of said two baffles being said baffle which is positioned upstream of said motor to intercept and redirect oil that backflows within said compressor housing and a second of said baffles being disposed so as to prevent the backflow oil from said location where oil collects in the first instance.

9. The refrigeration chiller according to claim 8 wherein said second baffle is downstream of said motor.

10. The refrigeration chiller according to claim 9 further comprising a first screw rotor; a second screw rotor; and, a capacity control valve, said first and said second rotors being disposed for rotation in said working chamber and said capacity control valve being positionable to vary the capacity of said compressor, the positioning of said capacity control valve to reduce the capacity of said compressor exposing said first and said second rotors to said location in said compressor housing where oil tends to collect.

11. The refrigeration chiller according to claim 9 wherein said second baffle is positioned to intercept and redirect the flow of oil away from the downstream exit of one of said suction passages.

12. The refrigeration chiller according to claim 2 wherein said at least one baffle is positioned to prevent oil from backflowing out of said location where oil tends to collect against the downstream flow of gas from said evaporator to said working chamber of said compressor.

13. The refrigeration chiller according to claim 12 further comprising a compressor drive motor disposed in said housing upstream of said working chamber and wherein said compressor housing defines at least one suction gas passage, said passage running exterior and along the length of said motor and opening into a location in said compressor housing at a location upstream and above the oil in said location where oil tends to collect, said at least one baffle being disposed so as to prevent the flow of oil from said location where oil tends to collect into said location into which said at least one suction gas passage opens.

14. A refrigeration chiller according to claim 1 further comprising a baffle disposed upstream of said motor and being disposed to redirect oil blown upstream through said at least one suction gas passage back to said location where oil tends to collect.

15. A screw compressor comprising:

a housing, said housing defining a working chamber, a suction area in which oil tends to collect and a location at which suction gas enters said housing;

a first screw rotor;

a second screw rotor, said first and said second screw rotors being disposed in intermeshing relationship in said working chamber, said suction area being defined intermediate said working chamber and said location at which suction gas enters said housing and being a location where oil tends to collect; and a baffle, said baffle being disposed in said housing, upstream of said working chamber but downstream of said location at which suction gas enters said housing, said baffle being positioned to prevent the backflow of oil from said suction area back to and through said location at which suction gas enters said compressor housing.

16. The screw compressor according to claim 15 further comprising a motor, said motor being connected to at least one of said first and said second rotors, said motor being disposed upstream of said suction area and downstream of said location at which suction gas enters said compressor housing.

17. The screw compressor according to claim 16 wherein said compressor housing defines a suction gas passage communication between said suction area and said location at which suction gas enters said housing, oil tending to be blown out of said suction area through said suction gas passage against suction gas that flows downstream through said suction gas passage under certain compressor operating conditions.

18. The screw compressor according to claim 16 wherein said baffle is disposed upstream of said motor and downstream of said location at which suction gas enters said compressor housing.

19. The screw compressor according to claim 18 wherein said baffle is disposed so as to intercept and redirect oil blown back through said suction gas passage to the location in said suction area where oil tends to collect.

20. The screw compressor according to claim 17 wherein said baffle is disposed downstream of said motor and in said suction area.

21. The screw compressor according to claim 20 wherein said baffle is disposed at the exit of said suction gas passage and is positioned so as to intercept and redirect oil which makes its way into the vicinity of the exit of said passage away therefrom, said baffle thereby preventing at least some oil from entering a location in said suction area from where it is susceptible to being blown back through said suction passage.

22. The screw compressor according to claim 17 wherein said baffle is disposed upstream of said motor and downstream of said location at which suction gas enters said compressor housing and further comprising a second baffle, said second baffle being disposed downstream of said motor and in said suction area.

23. The screw compressor according to claim 22 wherein said first baffle is configured and positioned to intercept oil which is blown back through said suction gas passage and to redirect such oil back to the location in said suction area where oil tends to collect and wherein said second baffle is configured to prevent the flow of oil to a location in said suction area where it is prone to being blown back through said suction gas passage in the first instance.

24. The screw compressor according to claim 23 wherein said motor housing defines at least one oil return passage through which oil intercepted and redirected by said first baffle is redirected into said suction area.

25. A method for preventing the backflow of oil from the compressor in a refrigeration chiller system to the refrigeration system evaporator comprising:

delivering refrigerant gas from said evaporator to said compressor in a downstream direction;

flowing said refrigerant gas delivered to said compressor in said delivering step in said downstream direction through said compressor and to a working chamber in said compressor;

flowing oil to said compressor for use therein, a portion of said oil collecting, after being used, in a location in said compressor which is upstream of said working chamber; and disposing at least one baffle in said compressor to intercept oil which flows out of said location where oil tends to collect in a direction which is opposite said downstream direction.

26. The method according to claim 25 comprising the further step of redirecting oil intercepted in said disposing step back to said location where oil collects in said compressor.

27. The method according to claim 26 wherein said compressor has a drive motor disposed upstream of said location where oil collects after its use and wherein said flowing step includes the step of flowing refrigerant gas around said motor in said downstream direction so as to cool said motor prior to the entry of said gas into said working chamber.

28. The method according to claim 27 wherein said disposing step includes the step of disposing said baffle upstream of said motor with respect to said downstream direction.

29. The method according to claim 27 wherein said disposing step includes the step of positioning said baffle downstream of said motor and upstream of said working chamber in said compressor.

30. The method according to claim 27 wherein said disposing step includes the steps of disposing a first baffle upstream of said motor and of disposing a second baffle downstream of said motor.

* * * * *

UNITED STATES PATENT AND TRADEMARK OFFICE

CERTIFICATE OF CORRECTION

PATENT NO. : 6,205,808 B1
DATED : March 27, 2001
INVENTOR(S) : Dennis M. Beekman It is certified that error appears in the above-identified patent and that said Letters Patent is hereby corrected as shown below:

Column 5,
Line 7, "blow" should read -- blown --.
Line 23, "driver" should read -- drive --.
Line 35, "exists" should read -- exits --.

Column 6,
Line 61, "lubricator" should read -- lubricant --.
Line 67, "passage" should read -- passages --.

Column 7,
Line 10, "component" should read -- compressor --.

Column 8, claim 1,
Line 28, "and" should read -- said --.

Column 10, claim 17,
Line 7, "communication" should read -- communicating --.

Signed and Sealed this

Twenty-sixth Day of March, 2002

*Attest:*

*Attesting Officer*

JAMES E. ROGAN
*Director of the United States Patent and Trademark Office*